US005974847A

United States Patent [19]

Saunders et al.

[11] Patent Number: 5,974,847

[45] Date of Patent: Nov. 2, 1999

[54] SUPERPLASTIC FORMING PROCESS

[75] Inventors: Frederick Irvin Saunders; Paul Edward Krajewski, both of Sterling Heights; Edward Frank Ryntz, Warren; James Gregory Schroth, Troy, all of Mich.

[73] Assignee: General Motors Corporation, Detroit, Mich.

[21] Appl. No.: 09/089,634

[22] Filed: Jun. 2, 1998

[51] Int. Cl.[6] ..... B21D 26/02

[52] U.S. Cl. ..... 72/57; 72/60; 29/421.1

[58] Field of Search ..... 72/60, 57, 58; 29/421.1

[56] References Cited

U.S. PATENT DOCUMENTS

| | | | |
|---|---|---|---|
| 3,373,585 | 3/1968 | Reynolds | 72/57 |
| 4,145,903 | 3/1979 | Leach et al. | 72/60 |
| 4,269,053 | 5/1981 | Agrawal et al. | 72/42 |
| 4,352,280 | 10/1982 | Ghosh | 72/38 |
| 4,741,197 | 5/1988 | Spuhler et al. | 72/427 |
| 4,984,348 | 1/1991 | Cadwell | 29/423 |

FOREIGN PATENT DOCUMENTS

| | | | |
|---|---|---|---|
| 2-15835 | 1/1990 | Japan | 72/57 |

OTHER PUBLICATIONS

Hamilton et al, "Superplastic Sheet Forming," *Metals Handbook, Ninth Edition,* vol. 14, "Forming and Forging," pp. 852–867.

*Primary Examiner*—David Jones
*Attorney, Agent, or Firm*—George A. Grove

[57] ABSTRACT

A method is disclosed for stretching sheet blanks, especially superplastic sheets, by differential gas pressure into conformity with a female die surface without encountering excessive thinning or tearing of the sheet. The warmed SPF sheet is draped over a preformed surface to draw more of the sheet material into the die cavity before the edges of the sheet are fixedly clamped whereby the additional formable material is used in forming the product, thereby reducing thinning and tears.

10 Claims, 4 Drawing Sheets

SUPERPLASTIC FORMING PROCESS

TECHNICAL FIELD

This invention pertains to forming of superplastic sheet material. More specifically, it pertains to a practice for reducing thinning or tearing of superplastic formable sheet material by displacing the material with solid die elements prior to using differential gas pressure to stretch the sheet into conformity with a die surface.

BACKGROUND OF THE INVENTION

There are metal alloys, for example, some aluminum and titanium alloys, that display exceptional ductility when deformed under controlled conditions. They are susceptible to extensive deformation under relatively low shaping forces. Such alloys are characterized as being superplastic. The tensile ductility of superplastic metal alloys typically ranges from 200% to 1000% elongation.

Superplastic alloy sheets are formed by a variety of processes into articles of manufacture that are frequently of complex shape. These superplastic forming (SPF) processes are usually relatively slow, controlled deformation processes that yield complicated products. But an advantage of SPF processes is that they often permit the manufacture of large single parts that cannot be made by other processes such as sheet metal stamping. Sometimes a single SPF part can replace an assembly of several parts made from non-SPF materials and processes.

There is a good background description of practical superplastic metal alloys and SPF processes by C. H. Hamilton and A. K. Ghosh, entitled "Superplastic Sheet Forming" in *Metals Handbook. Ninth Edition*, Vol. 14, pages 852–868. In this text several suitably fine grained, superplastic aluminum and titanium alloys are described. Also described are a number of SPF processes and practices for forming superplastic materials. One practice that appears to be adaptable to forming relatively large sheets of relatively low cost superplastic aluminum alloys into automobile body panels or the like is stretch forming.

As described, stretch forming comprises gripping or clamping the flat sheet blank at its edges, heating the sheet to its SPF temperature and subjecting one side to the pressure of a suitable gas such as argon. The central unclasped portion of the sheet is stretched and plastically deformed into conformity with a shaping surface such as a die cavity surface. The term "blow forming" applies where the working gas is at super-atmospheric pressure (e.g., up to 690 to 3400 kPa or 100 psi to 500 psi). Vacuum forming describes the practice where air is evacuated from one side of the sheet and the applied pressure on the other side is limited to atmospheric pressure, about 15 psi. As stated, the sheet and tools are heated to a suitable SPF condition for the alloy. For SPF aluminum alloys, this temperature is typically in the range of 400° C. to 550° C. The rate of pressurization is controlled so the strain rates induced in the sheet being deformed are consistent with the required elongation for part forming. Suitable strain rates are usually 0.0001 to 0.01 $s^{-1}$.

In stretch forming, a blank is tightly clamped at its edges between complementary surfaces of opposing die members. A schematic example is shown in FIG. 9, page 857 of the Hamilton et al article, supra. At least one of the die members has a cavity with a forming surface opposite one face of the sheet. The other die opposite the other face of the sheet forms a pressure chamber with the sheet as one wall to contain the working gas for the forming step. The dies and the sheet are maintained at an appropriate forming temperature. Electric resistance heating elements are located in press platens or sometimes embedded in ceramic or metal pressure plates located between the die members and the platens. A suitable pressurized gas such as argon is gradually introduced into the die chamber on one side of the sheet, and the hot, relatively ductile sheet is stretched at a suitable rate until it is permanently reshaped against the forming surface of the opposite die. During the deformation of the sheet, gas is vented from the forming die chamber.

The superplastic sheet employed in the SPF process is capable of undergoing appreciable elongation. However, since the sheet is clamped between the die members in a gas-tight seal, the only material available for the stretch forming is the area of the sheet within its clamped edges. Deformation of the sheet is seldom uniform, and excessive thinning of the sheet is likely in the more elongated regions. In the forming of pan-shaped articles, for example, it is often difficult to produce a tear-free product of reasonably uniform thickness across the part.

It is desired to adapt SPF practices to forming panels of complex shape for automotive applications. Light weight aluminum alloy sheets, for example, could be blow formed or vacuum formed into intricately shaped thin wall structures incorporating many subcomponents that would have required separate manufacture and assembly using less ductile aluminum alloys, for example, and conventional stamping practices. However, such intricate components must have reasonably uniform wall thickness and they must be free of tears and breaks. A robust process is required for high volume, low cost production of large stretch-formed parts. A process is required that can produce uniformly high quality parts in day-to-day manufacturing operations. Present SPF stretch form processes do not fill this need.

SUMMARY OF THE INVENTION

This invention provides a method of stretch forming a ductile metal sheet into a complex shape involving significant deformation without excessive thinning of the sheet material and without tearing it. The method is particularly applicable to the stretch forming of superplastic alloys heated to a superplastic forming temperature. In this method, additional material from the initially flat sheet blank is pulled or drawn into the forming cavity for stretch forming. The additional material significantly reduces thinning and tearing in the formed part.

The subject method contributes to thickness uniformity in an SPF stretch-formed component by utilizing controlled draw-in of sheet metal to the forming chamber prior to application of gas pressure. In an illustrative practice, a preform, similar to a stationary male punch, is placed on the forming press platen opposite the die cavity. An aluminum blank, for example, is placed over the insert and heated to a suitable SPF temperature for the alloy. The die is then moved toward its closed position against the platen. In its closing motion, the die engages the edges of the aluminum sheet. The heated metal is pulled over and around the insert, and draw-in of blank material thus occurs. This results in a greater amount of metal in the die cavity prior to SPF blow forming. The quantity of additional metal can be managed by design of the size, shape and location of the preform on the platen or complementary die member. But the additional metal in the die cavity reduces the amount of strain required and, hence, the amount of thinning to form a desired geometry compared to conventional SPF.

Thus, by the judicious use of a suitable space-occupying metal preform on a die or platen member opposite the forming die, additional metal is easily drawn into the cavity during die closure without significantly increasing the complexity of the tooling. Care is taken in the design of the preform to avoid excessive wrinkling of the drawn-in metal and to maintain a tight gas seal at the periphery of the sheet upon full die closure. The uniformity in thickness of the stretch-formed part is improved. Mass of the formed part can be reduced because the designer does not need to resort to thicker blanks to assure part quality. And, except for the simple preform, there is no increase in the complexity of the SPF tooling.

Other objects and advantages of the invention will become more apparent from a detailed description of the invention which follows. Reference will be made to the drawings.

DESCRIPTION OF THE PREFERRED EMBODIMENT

Figure 1:
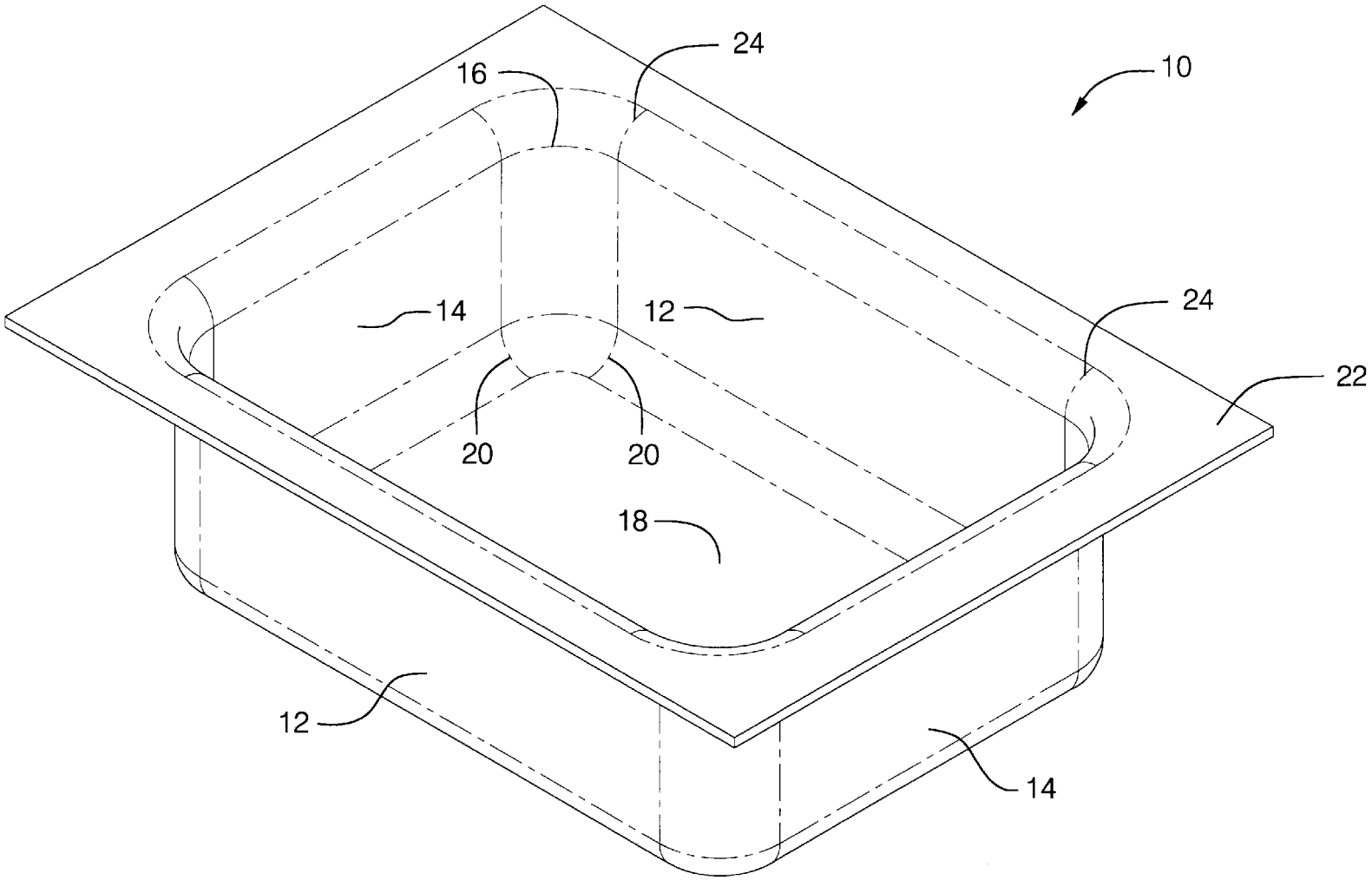
FIG. 1 is a perspective view of a deep, stretch-formed pan produced from a flat sheet of superplastic formable Aluminum Alloy 5083 in accordance with this invention.

The process of this invention was demonstrated in the making of a blow-formed pan shown schematically in FIG. 1. Pan 10 is generally rectangular with an inside length of 386 mm and an inside width of 309 mm. The radius 16 between side walls 12 and end walls 14 is 76.6 mm. The depth of the pan is 127 mm. The radius 20 between the bottom 18 of pan 10 and the side 12 and end 14 walls is 25.4 mm. The radius 24 between the top flange 22 and the side and end walls is 8.1 mm. The pan configuration was chosen for evaluation of the subject SPF stretch-forming process because it requires drastic elongation and deformation of portions of a sheet blank and often results in excessive thinning or tearing of the material, particularly in the region of the bottom 18 or bottom radius 20.

Pan 10 was formed using 1.2 mm thick sheet of a commercially available, superplastic formable Aluminum Alloy 5083. The 5083 alloy had a nominal composition, by weight, of 4 to 4.9% magnesium, 0.4 to 1% manganese, 0.05 to 0.25% chromium, about 0.1% copper and the balance aluminum. The cold-rolled sheet had been processed for SPF and had a fine, stable grain structure (~10 $\mu$m) suitable for SPF. The sheets were lubricated with boron nitride before superplastic forming. Forming was done at about 500° C. at a strain rate in the range of $10^{-4}$ to $10^{-3}$ second$^{-1}$. The forming cycle time was six minutes.

The process of this invention will be illustrated with reference to FIGS. 2A through 2C and FIG. 3. The stretch forming tooling 30 comprises lower platen 32 and upper die platen 34 carrying the female forming die 36. Die 36, shown in section, has forming surfaces 38, 40, 42 and 44 that define a cavity 46. Die surface 38 corresponds to pan bottom 18. Die surfaces 40 correspond to pan side walls 12. Die surfaces 42 correspond to pan bottom radii 20 and surfaces 44 correspond to flange radii 24. Die surfaces 44 terminate in flat die surfaces 48 that serve to form the flanges 22 of pan 10 and to engage a sheet metal blank as will be more fully described. Obviously, blank sheet metal must be forced into cavity 46 against the respective forming surfaces to deform it into the shape of the pan.

Steel preform block 50 is positioned on lower platen 32 so that it underlies and is opposite cavity 46. Block 50 is a rounded rectangular block with a flat top having dimensions slightly smaller than the dimensions of cavity 46. The specific dimensions of block 50 were 205 mm long×292 mm wide×50.8 mm high. Block 50 is shown as being a single piece. Obviously, any preform may be formed of a plurality of pieces.

A sheet 60 of SPF Aluminum alloy 5083 is placed on the top of preform 50. The sheet 60 was rectangular in shape with dimensions of 533 mm by 635 mm. Sheet 60 is sized so that its edges 62 extend outside the reach of forming die surfaces 48.

Figure 2A:
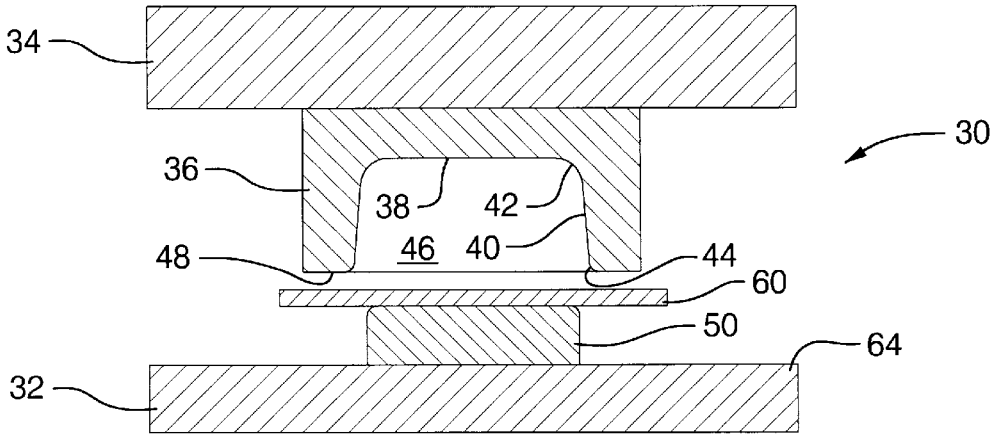
FIGS. 2A–2C are schematic elevation views in cross-section illustrating the position of the superplastic formable sheet and the forming dies during three steps in the practice of this invention.
Figure 2B:
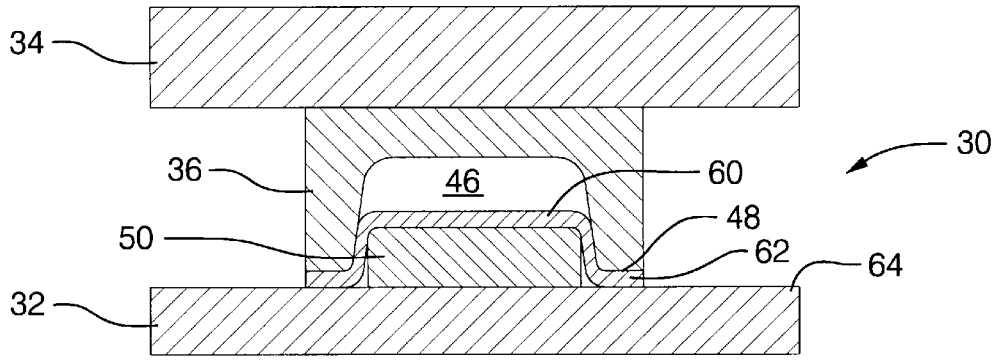
Figure 2C:
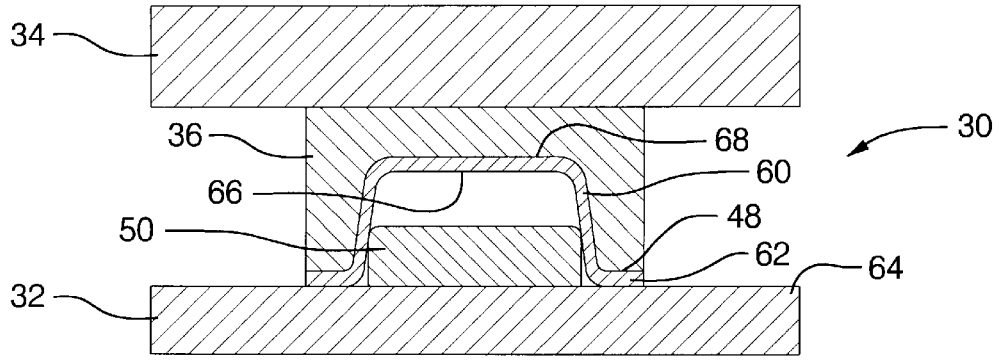
Figure 3:
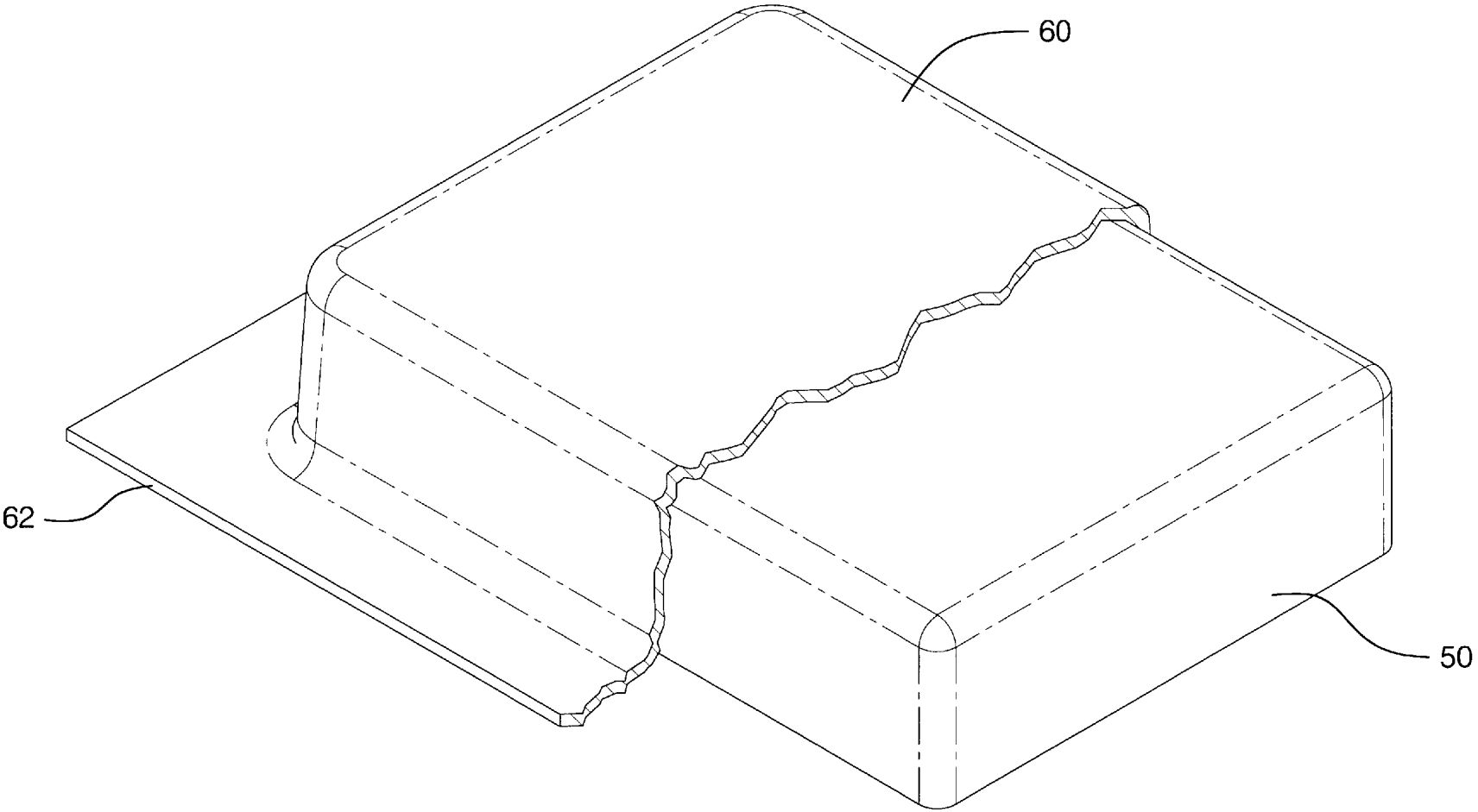
FIG. 3 is a perspective view of a heated sheet preformed over a block at the forming stage depicted in FIG. 2B. The preformed sheet and block as shown are isolated from the tooling.

When sheet 60 is in place, the sheet and die members 32 and 36 are electrically heated by resistance elements, not shown, to the desired SPF temperature—in this case about 500° C. for the 5083 alloy. The upper forming die 36 is then slowly lowered toward die platen 32 into engagement with the periphery of sheet 60 (FIG. 2B). As die 36 is lowered, it pulls the heated sheet 60 down around insert 50. More of the material of the initially flat sheet 60 is thus drawn into the cavity region 46 of the forming die 36. When die 36 is fully lowered against the edges 62 of sheet 60,0 it presses the edges into sealing engagement with the complementary surface 64 of platen 32. Obviously, much more of the sheet has been drawn into die cavity 48 than would have been enclosed within the die if the sheet had simply been stretched flat between the die members (see FIG. 3).

After full closure of die members 32 and 36, high pressure gas, such as nitrogen or argon, is admitted against the back side 66 of heated sheet 60 through a suitable gas passage (not shown) in platen 32 or other suitable location. Concurrently, gas may be vented from die cavity 46 through vent passages (not shown) in die 36 or other suitable location. Die 36 engages front surface 68 at edges 62 of sheet 60. Die platen 32 engages the back side 66 at the edges 62 of sheet 60. The die members grip the sheet 60 in gas-tight sealing lockbead (not shown) engagement so that suitable gas pressure is maintained on the back side of the soft sheet to stretch it into full compliance with the forming surfaces of die 32. Sheet 60 is gripped at edges 62 so that the blow-forming step occurs substantially entirely by stretching (see FIG. 2C).

This high pressure blow-forming operation was conducted by gradually increasing the argon pressure to 62 kPa over a period of four minutes. As stated, the complete forming step of the pan after die closure took six minutes. The pressure was then relieved, the dies opened and a completed pan 10 was removed. The pan formed completely without splits or significant cavitation.

An attempt was made to form the identical pan from the same commercial SPF aluminum alloy 5083 and the same dies except that no insert was placed on plenum 32. The sheet 60 was simply placed flat on plenum surface 64 preparatory to heating and die closure. A smaller area of the sheet existed between the die gripped edges 62. Although the same forming temperature and pressure management was practiced, a pan could not be formed without forming splits and tears in sides and bottom. This result clearly demonstrates the improvement in formability provided by using inserts to promote and control material draw-in prior to the superplastic stretch forming operation.

Figure 4:
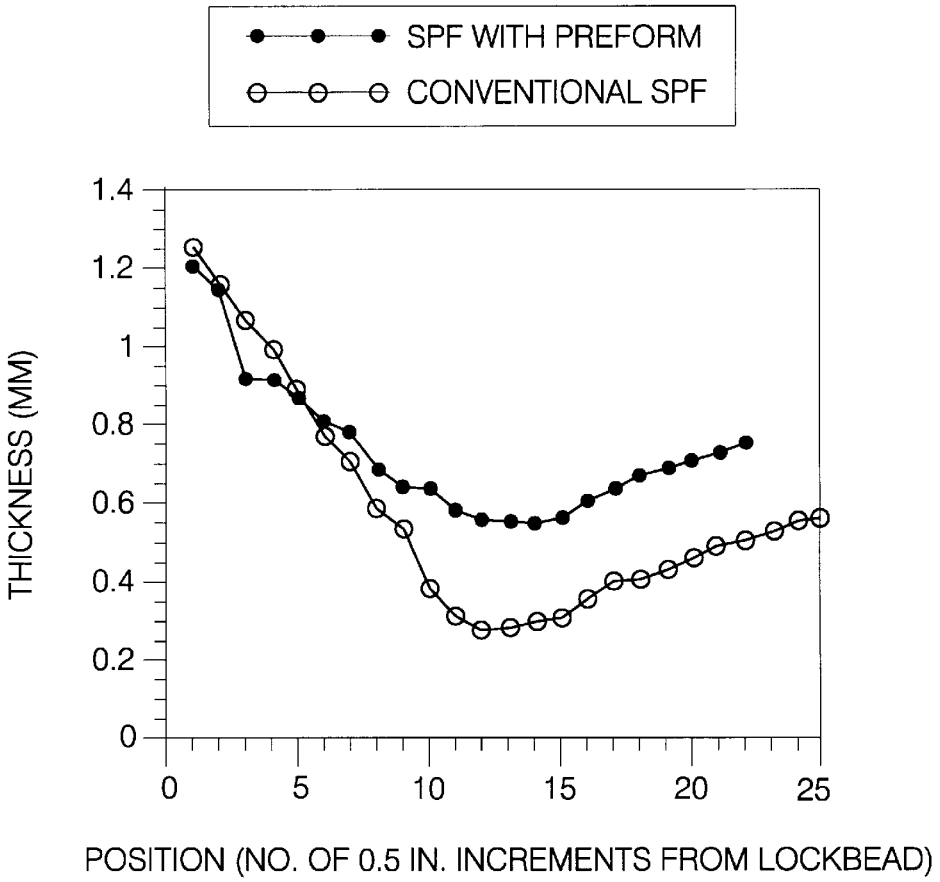
FIG. 4 is a graph of metal thickness values over portions of stretch-formed pans, one formed by a conventional SPF practice and one in accordance with the draw-in practice of this invention.

The use of the preform to assist in providing additional sheet material for stretch forming the pan 10 also reduced thinning during SPF. The thickness distribution in the pans formed with and without a preform is shown in FIG. 4. FIG. 4 is a graph of pan wall thickness in 12.7 mm increments measured from the lockbead ridge on the flange of the pans. The thickness values for the pan made with the insert as described above are shown as filled circles (●). As stated above, the initial thickness of the commercial SPF 5083 sheet was 1.2 mm. The pan made without a preform was made with a second material, a premium SPF grade 1.2 mm 5083 sheet because the pan could not be made by the originally-selected commercial SPF sheet without tearing. The thickness data for the conventional SPF pan is entered as open circles (○). It is clearly seen that the pan formed using the preform of this invention had a much thicker bottom and more uniform thickness than the pan made without a preform, i.e., solely by SPF. The minimum thickness in the pan made using a preform was 0.55 mm compared to 0.28 mm in the non-preform pan, while the bottom thickness was 0.66 mm compared to 0.40 mm in the non-preform pan.

This reduction in thinning can translate to significant mass reduction in parts which have critical performance requirements. For example, if an average bottom thickness of 1.0 mm is specified for the pan used in the present example, 1.85 mm thick blank material would be required if a preform was used compared to 2.95 mm thick blank material without a preform. This would result in a 21% reduction in part mass.

The practice of the invention has been described using AA 5083 that had been specially processed for SPF. The invention may also be practiced using other aluminum or titanium alloys, e.g., or with conventionally-processed aluminum alloys such as 5182 or 5454. Any material or process capable of producing substantial thickness reductions, e.g., 50% or more, can benefit from this invention.

Figure 5:
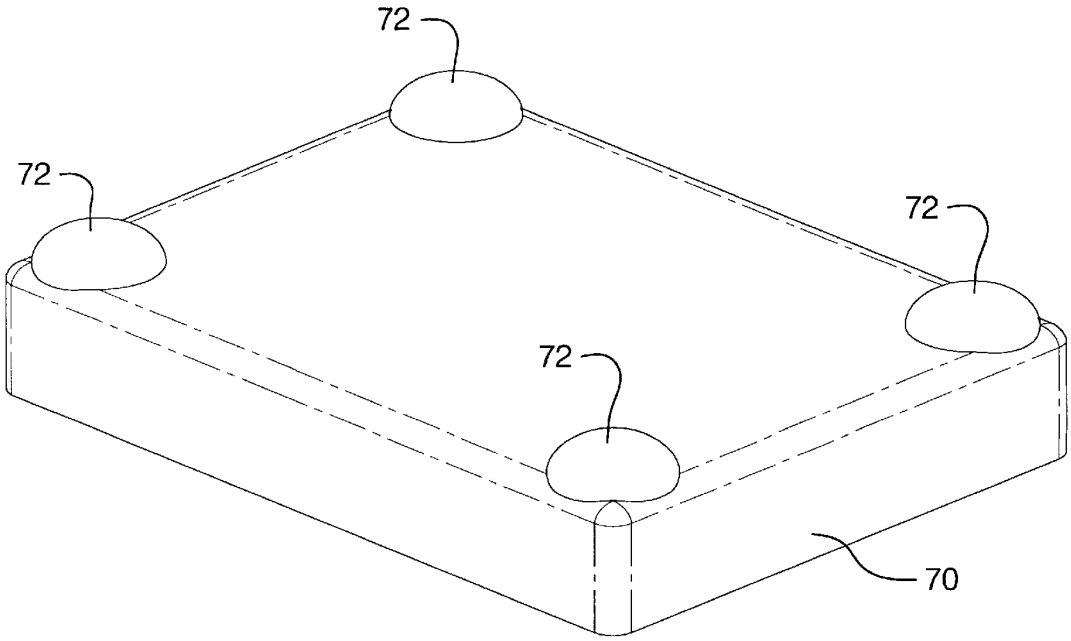
FIG. 5 illustrates a second embodiment of a preform for use in the practice of this invention.

The preform used to gather material and produce draw-in was rectangular with rounded corners roughly the size of the SPF die. A variety of insert geometries can be used to produce draw-in including domes and cylinders. The amount of material draw-in is controlled by the height, shape and position of the male preform The preform may be tailored to produce a desired strain distribution. For example, a rectangular preform 70 with four raised corners 72 (see FIG. 5) serves to increase the thickness of corner sections in pan shapes as described above.

The shape of the preform is intentionally kept simple to perform the required draw-in of the aluminum while minimizing costly three-dimensional sculpturing that is required in a multi-part, matched stamping die.

There are, of course, alternative methods (with respect to the preforms described) for achieving draw-in. A double action press could be used to provide the sealing pressure for forming as well as the motion of a punch acting on the backside of the sheet blank to create draw-in. A key component in this arrangement would be a two-part sealing/binder ring that allowed draw-in and upon further actuation provided suitable pressure for gas sealing. Another alternative to preforms placed on a stationary die is the use of nitrogen pressure, either alone or in combination with a double action press, to produce draw-in during SPF. The nitrogen pressure could be used to activate a punch, produce the clamping force for the draw-in operation, or to activate a sealing bead.

While this invention has been described in terms of some specific embodiments, it will be appreciated that other forms can readily be adapted by one skilled in the art. Accordingly, the scope of this invention is to be considered limited only by the following claims.

We claim:

1. A method of stretch forming a flat ductile metal sheet to reduce metal thinning and tears in the formed product, said method comprising placing said sheet between first and second die members movable between a die open position, for insertion of said sheet and removal of a formed product, and a die closed position in which said dies sealingly engage the periphery of said sheet for stretch forming of the die enclosed area of the sheet utilizing differential gas pressure, said first die member having a forming surface and defining a cavity between said forming surface and a first surface of a said sheet, said second die having a sheet metal shaping surface opposite said cavity, said dies being in said die open position and said sheet being positioned between said preform surface and said cavity;

heating said sheet to a stretch forming temperature;

moving said dies to their closed position such that said first die engages the periphery of said sheet and pulls the heated sheet against said second die shaping surface to draw sheet material into said cavity so that said sheet is no longer flat and more sheet material is disposed within its sealingly engaged periphery than if the sheet had remained flat; and applying gas pressure to the second side of said sheet to stretch the sheet into conformity with said first die forming surface.

2. A method as recited in claim 1 in which said metal is an aluminum alloy.

3. A method as recited in claim 1 or 2 in which said sheet metal is superplastic formable and is heated to a superplastic-forming temperature before or during die closure.

4. A method as recited in claim 1 or 2 in which said sheet metal is a superplastic-formable Aluminum Alloy 5083 that is heated to a superplastic-forming temperature above 400° C. before or during die closure.

5. A method as recited in claims 1 or 2 in which said shaping surface is made with a configuration geometrically similar to the cavity surface.

6. A method of stretch forming a flat ductile metal sheet to reduce metal thinning and tears in the formed product, said method comprising placing said sheet between first and second die members movable between a die open position, for insertion of said sheet and removal of a formed product, and a die closed position in which said dies sealingly engage the periphery of said sheet for stretch forming of the die enclosed area of the sheet utilizing differential gas pressure, said first die member having a forming surface and defining a cavity between said forming surface and a first surface of a said sheet, said second die having a sheet metal shaping surface opposite said cavity, said dies being in said die open position and said sheet being positioned between said preform surface and said cavity;

heating said sheet to a stretch forming temperature;

moving said dies to their closed position such that said first die engages the periphery of said sheet and said second die shaping surface engages the sheet to draw sheet material into said cavity so that said sheet is no longer flat and more sheet material is disposed within its sealingly engaged periphery than if the sheet had remained flat; and applying gas pressure to the second side of said sheet to stretch the sheet into conformity with said first die forming surface.

7. A method of stretch forming a flat ductile metal sheet to reduce metal thinning and tears in the formed product, said method comprising placing said sheet between first and second die members movable between a die open position, for insertion of said sheet and removal of a formed product, and a die closed position in which said dies engage the periphery of said sheet, said first die member having a forming surface and defining a cavity between said forming surface and a first surface of a said sheet, said second die having a sheet metal shaping surface opposite said cavity, said dies being in said die open position and said sheet being positioned between said preform surface and said cavity;

heating said sheet to a stretch forming temperature; and moving said dies to their closed position such that said first die engages the periphery of said sheet and said second die shaping surface engages the sheet to draw sheet material into said cavity so that said sheet is no longer flat and more sheet material is disposed within its engaged periphery than if the sheet had remained flat.

8. A method as recited in claim 6 or 7 in which said metal is an aluminum alloy.

9. A method as recited in claim 6 or 7 in which said metal sheet is superplastic formable and is heated to a superplastic forming temperature before or during die closure.

10. A method as recited in claim 6 or 7 in which said metal sheet is superplastic-formable Aluminum Alloy 5083 that is heated to a superplastic forming temperature above 400° C. before or during die closure.

* * * * *